US008256387B2

(12) United States Patent
Taylor

(10) Patent No.: US 8,256,387 B2
(45) Date of Patent: Sep. 4, 2012

(54) RADIATOR SHUTTER USING FILM DOOR TECHNOLOGY

(75) Inventor: Dwayne Robert Taylor, Livonia, MI (US)

(73) Assignee: DENSO International America, Inc., Southfield, MI (US)

( * ) Notice: Subject to any disclaimer, the term of this patent is extended or adjusted under 35 U.S.C. 154(b) by 727 days.

(21) Appl. No.: 12/431,386

(22) Filed: Apr. 28, 2009

(65) Prior Publication Data

US 2010/0269767 A1 Oct. 28, 2010

(51) Int. Cl.
*F01P 7/02* (2006.01)

(52) U.S. Cl. ..... 123/41.05

(58) Field of Classification Search ..... 123/41.04–41.07
See application file for complete search history.

(56) References Cited

U.S. PATENT DOCUMENTS 4,475,485 A 10/1984 Sakakibara et al.
4,546,742 A * 10/1985 Sturges ..... 123/41.05
4,753,288 A 6/1988 Harvey
4,756,279 A * 7/1988 Temmesfeld ..... 123/41.04
4,779,577 A * 10/1988 Ritter et al. ..... 123/41.05
6,926,253 B2 8/2005 Tokunaga et al.
7,128,026 B2 * 10/2006 Braun et al. ..... 123/41.05
7,784,576 B2 * 8/2010 Guilfoyle et al. ..... 123/41.04

* cited by examiner

*Primary Examiner* — Noah Kamen
(74) *Attorney, Agent, or Firm* — Harness, Dickey & Pierce,PLC

(57) ABSTRACT

An apparatus for controlling airflow to and a temperature of an engine may employ a radiator with liquid coolant, a first roller positioned parallel to an inlet tank and a second roller positioned parallel to an outlet tank, and a single film shutter that winds upon each roller. Thin strip leaders define gaps for airflow to reach the radiator. A method of controlling an open position of the film shutter may entail calculating a first film shutter open position based upon an engine coolant temperature, calculating a second film shutter open position based upon an air conditioning output pressure, comparing the first film shutter open position to the second film shutter open position, determining the larger open position, and moving the film shutter to the larger open position to expose a greater radiator surface area than the smaller open position.

19 Claims, 5 Drawing Sheets

Fan Speed
High
Low
OFF
96
98
94
Tfl
Pfl
Tfh
Pfh
Tw, Pd 104
100
SFos
102
An = 100%
A(n-1)
Filmdoor Position (x)
A3
A2
A1
Ao = 0%
T1
P1
T2
P2
T3
P3
Tn
Pn
Tw, Pd Thermostat Position
FULLY OPEN
FULLY CLOSED
75
73
Tso
Tfo
Tw

RADIATOR SHUTTER USING FILM DOOR TECHNOLOGY

FIELD

The present disclosure relates to a film used as a shutter to control airflow through a heat exchanger, or a quantity of heat exchangers arranged in series, and a method of controlling the position of the film.

BACKGROUND

This section provides background information related to the present disclosure which is not necessarily prior art. Modern vehicles, such as passenger cars and commercial trucks, that utilize internal combustion engines, may each employ a heat exchanger package, such as a radiator, air conditioning condenser and fans, in the front of the vehicle to remove heat from the internal combustion engine. Such heat exchanger packages are not without their share of limitations. Normally, heat is removed when air flows through a front end opening to access the radiator and air conditioning condenser, for example. The front end opening is usually configured to remove as much heat as possible, or in other words, to permit the largest volume flow rate of air to pass through the front end opening and through the radiator, with little or no means to control the airflow volume. In one instance, metal horizontal louvers may be utilized on a grill or radiator of a vehicle; however, such louvers may protrude one to two inches from a surface of a radiator, thus adding weight and extending the length of a vehicle. Without such louvers, airflow amounts that are higher than necessary exist for many of the vehicle operating conditions, which increases the aerodynamic drag of the vehicle, diminishes vehicle heater performance, and increases engine emissions by delaying engine warm up time. What is needed then is an apparatus and a method of operating the apparatus that does not suffer from the above limitations and improves the vehicle operating conditions.

SUMMARY

This section provides a general summary of the disclosure, and is not a comprehensive disclosure of its full scope or all of its features. An apparatus for controlling a temperature of an engine may employ a radiator with an inlet tank and an outlet tank. The radiator may contain a liquid engine coolant, such as water or an anti-freeze liquid. A first roller may be positioned vertically and parallel to the inlet tank while a second roller may be positioned vertically and parallel to the outlet tank. A single sheet of flexible film, also known as a film shutter, may be wound upon the first roller and the second roller to pass in front of and adjacent to the large frontal surface of the radiator. Film leaders, such as thin strips of the film, may define gaps between the strips. The gaps permit air to flow past and through the film shutter to reach the radiator and cool the liquid in the radiator. The air may also cool the exterior of the engine. A first motor may drive the first roller while a second motor may drive the second roller. A temperature sensor may be installed in the coolant circuit to measure temperatures of the liquid engine coolant and communicate with a control module that processes the measured temperatures from the temperature sensor and communicates with the first and second motors to turn the first and second rollers and move the film shutter. The film shutter may be located between the radiator and an air conditioning condenser. In addition, a pressure sensor may be installed in the air conditioning refrigerant circuit that measures the high side refrigerant pressure of the air conditioning system (i.e., anywhere in the refrigerant circuit between the compressor and the expansion device) and communicates with a control module that processes the measured pressure from the pressure sensor and communicates with the first and second motors to turn the first and second rollers and move the film shutter. Thus, the volume airflow to the a/c condenser, the radiator and the engine may be controlled to govern the temperature of the engine and liquid coolant, as well as the a/c system pressure.

A method of controlling an open position of a film shutter for a radiator of a vehicle may entail inquiring whether an ignition key is in an "on" position, concluding that the ignition key is in the "on" position, calculating a first film shutter open position based upon an engine coolant temperature, and calculating a second film shutter open position based upon an air conditioning output pressure. The method may also then entail comparing the first film shutter open position to the second film shutter open position and arriving at a comparison result such that one of the first and second film shutter open positions is a larger open position and one of the first and second film shutter open positions is a smaller open position. Based upon the comparison, the method may involve moving the film shutter to the larger open position such that the larger open position exposes a greater radiator surface area than the smaller open position.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure. In accordance with the present disclosure:

Corresponding reference numerals indicate corresponding parts throughout the several views of the drawings.

DETAILED DESCRIPTION

Figure 1:
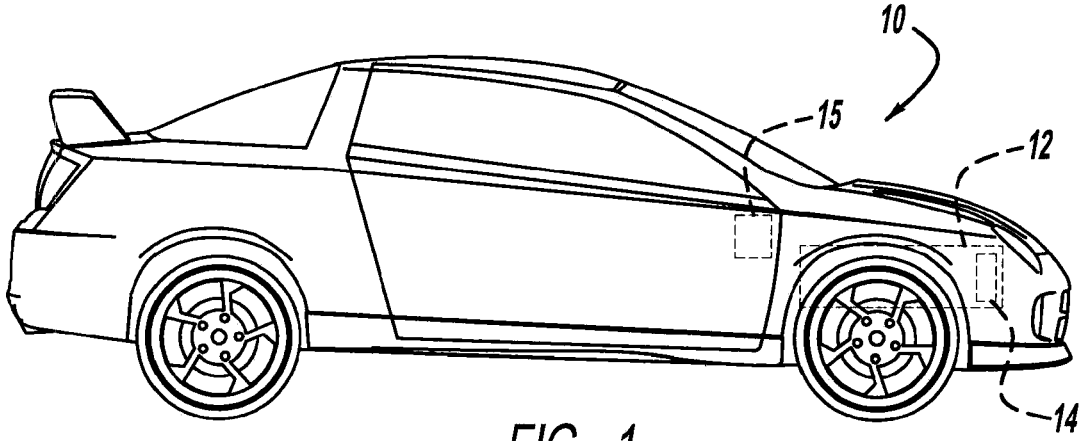
FIG. 1 is a side view of a vehicle depicting the location of an internal combustion engine, vehicle air conditioner unit, and heat exchanger package.
Figure 2:
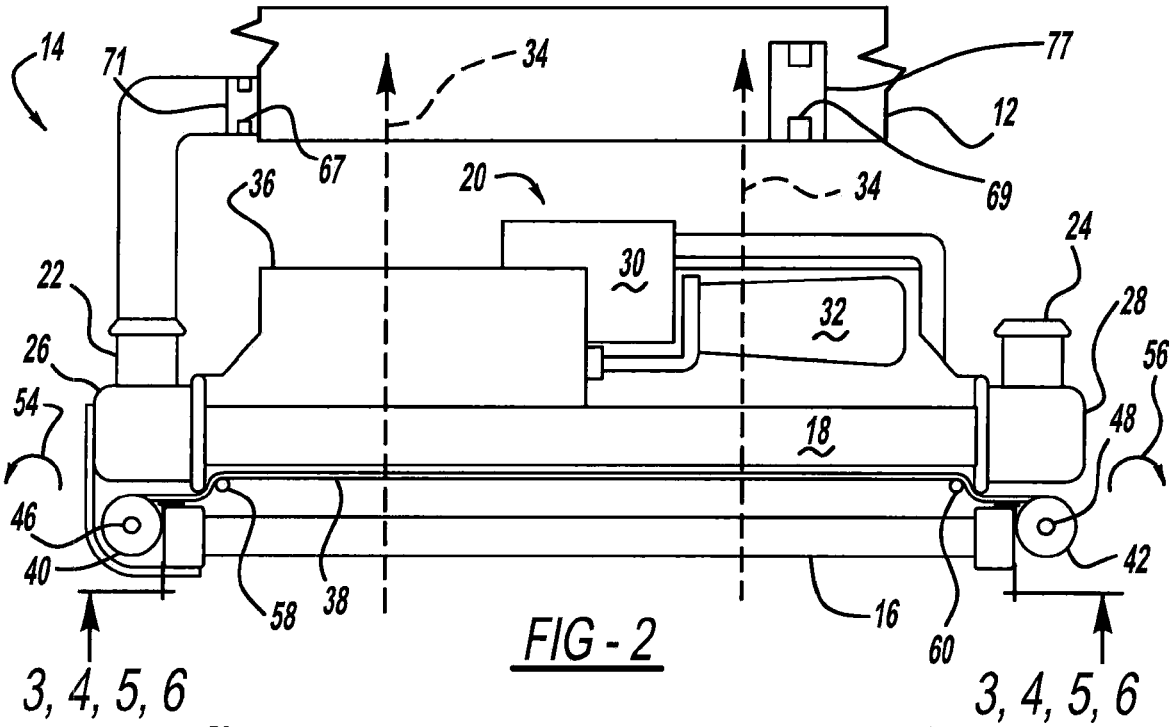
FIG. 2 is a top view of a condenser/radiator/fan module (CRFM) and corresponding film door and defines the section location for FIGS. 3-6.
Figure 4:
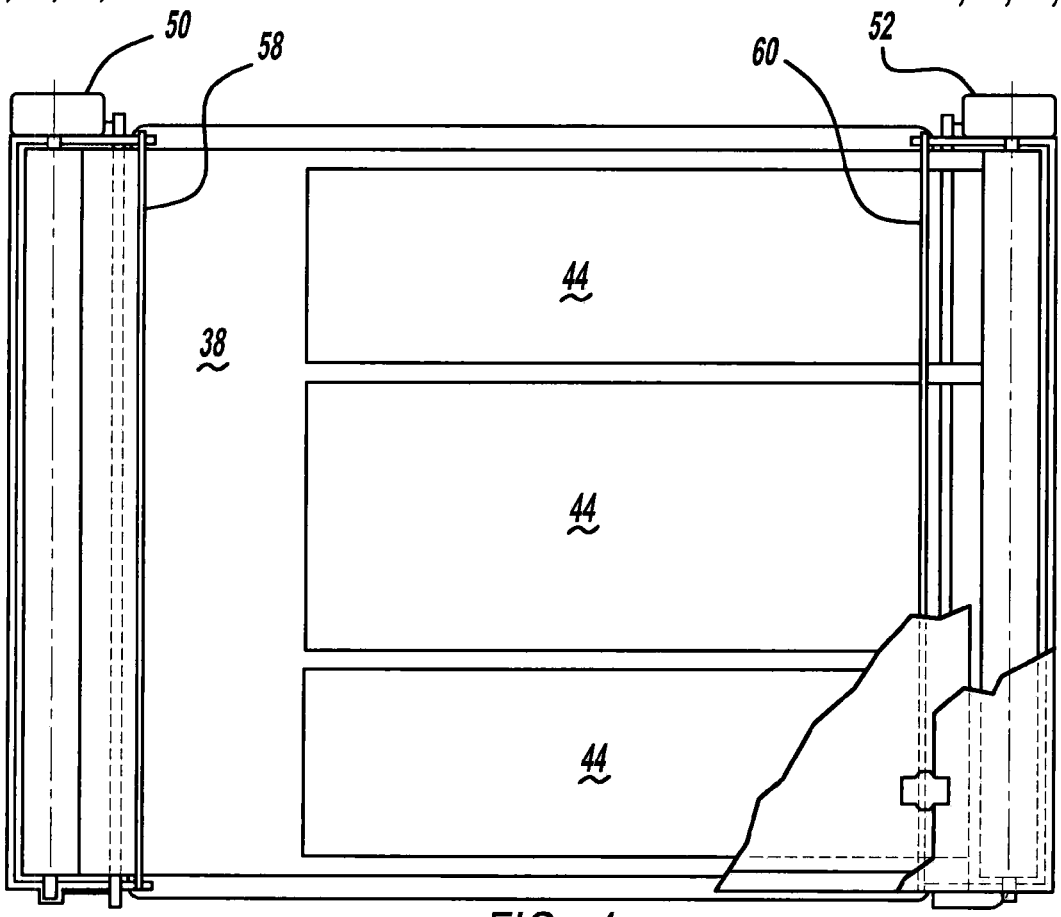
FIG. 4 is a section view of a condenser/radiator/fan module (CRFM) and corresponding film door in a specific position.
Figure 5:
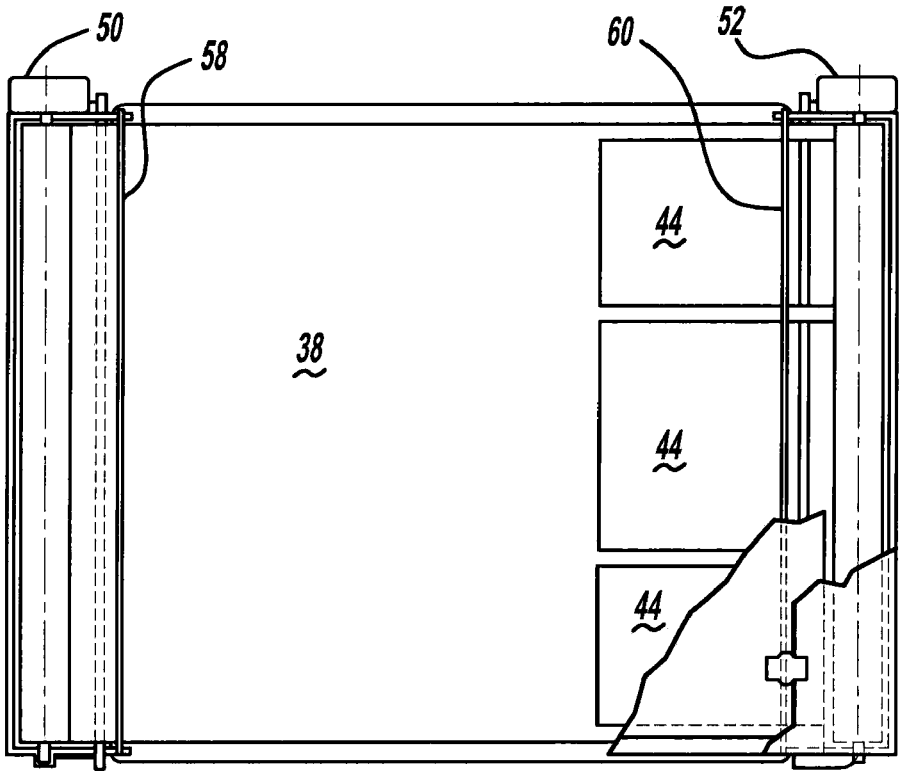
FIG. 5 is a section view of a condenser/radiator/fan module (CRFM) and corresponding film door in a specific position.

Example embodiments will now be described more fully with reference to the accompanying drawings. Turning now to FIGS. 1-8, teachings of the present disclosure will be presented. FIG. 1 depicts vehicle 10 within which internal combustion engine 12 resides. FIG. 2 depicts condenser/radiator/fan module ("CRFM") 14, which may be employed to cool engine 12 and the vehicle air conditioner 15. CRFM 14 may employ condenser 16, radiator 18, and fan module 20. More specifically, radiator 18 may be equipped with radiator inlet 22 and radiator outlet 24, which serve as respective inlets and outlets for liquid coolant. Radiator inlet 22 may be resident in radiator inlet tank 26 and radiator outlet 24 in radiator outlet tank 28. Continuing, CRFM 14 may also employ one or more electric motor 30, which may be located within or covered by a hub, to drive or rotate a fan 32 or fans to draw or pull air 34 through condenser 16 to cool the vehicle air conditioner 15 and radiator 18 to cool engine 12. Fan shroud 36 may be employed against radiator 18 to direct or channel airflow 34 directly toward and over an outside surface of engine 12.

Figure 3:
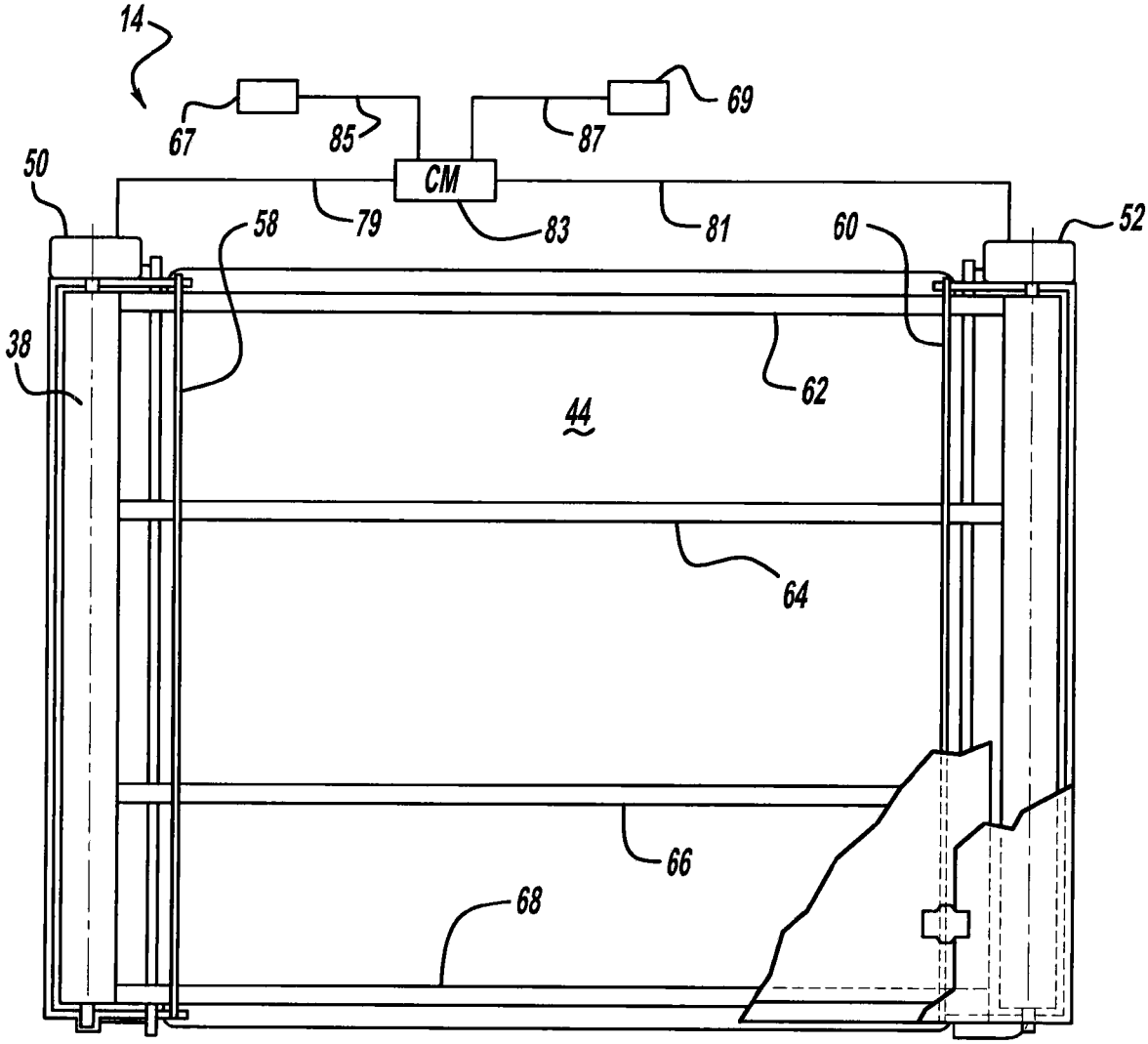
FIG. 3 is a section view of a condenser/radiator/fan module (CRFM) and corresponding film door in a specific position, and a diagram depicting a connectivity scenario between roller motors, a control module and sensors used as inputs to control the system.

Continuing, and with reference including FIGS. 2-6, CRFM 14 may employ a thin plastic film shutter 38, known as a film door or film shutter, that physically lies against the radiator 18 or resides immediately adjacent to the radiator 18 so as to form a gap with radiator 18, such as from 1 mm to 30 mm from surface 44 of radiator 18. More specifically, the film shutter 38 may reside on first roller 40 and second roller 42 such that roller 40 may rotate on first shaft 46 and second roller 42 may rotate on second shaft 48. FIG. 3 depicts first motor 50 positioned at a top surface of radiator 18, and more specifically, atop first shaft 46, while second motor 52 is also positioned at a top surface of radiator 18, and more specifically, atop second shaft 48. Motors 50, 52 are coupled, respectively, to shafts 46, 48 to drive or turn shafts 46, 48. In an exemplary example, when shaft 46 is driven to turn counterclockwise ("CCW"), in accordance with arrow 54 in FIG. 2, film shutter 38 will move toward a non-driver side of the vehicle 10 thereby exposing more of the radiator surface 44 to airflow 34 to remove heat from the liquid coolant within the radiator 18, which circulates through engine 12. To the contrary, when shaft 48 is driven to turn clockwise ("CW"), in accordance with arrow 56 in FIG. 2, film shutter 38 will move toward a driver side of the vehicle 10 thereby decreasing exposure of the radiator surface 44 and the condenser 16 to airflow 34 to prevent heat removal from the liquid coolant within the radiator 18, which circulates through engine 12, and from the refrigerant within the condenser 16, which circulates through the air conditioner unit 15. To facilitate movement of film shutter 38 along radiator surface 44, a first guide bar 58 and a second guide bar 60 may be positioned as depicted in FIGS. 2-6 to maintain film shutter 38 parallel to radiator surface 44.

Figure 6:
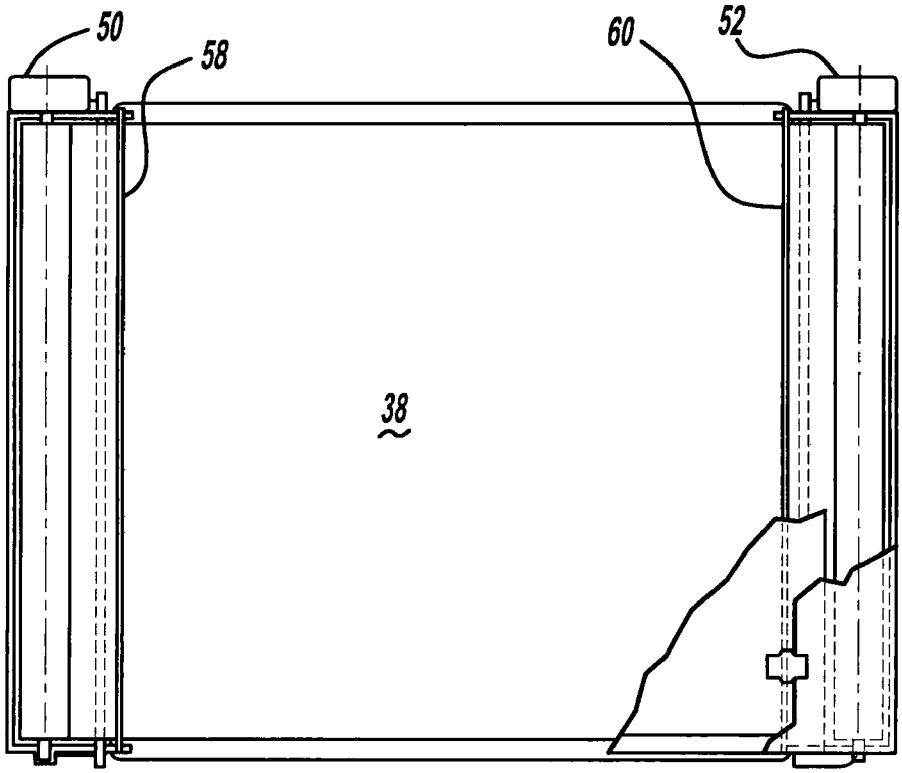
FIG. 6 is a front view of a condenser/radiator/fan module (CRFM) and corresponding film door in a specific position.

In operation, when for instance, second motor 52 rotates shaft 48 clockwise, film leaders 62, 64, 66, 68, which are strands that are part of film shutter 38, are wound upon shaft 48 to cause film shutter 38 to move across radiator surface 44 causing a blockage of airflow 34 from reaching radiator 18 and condenser 16. More specifically, when second motor 52 rotates shaft 48 clockwise, film shutter 38 may first be positioned as depicted in FIG. 3 with film shutter 38 not covering or blocking any portion of radiator surface 44 or condenser 16. As film leaders 62, 64, 66, 68 are wound upon shaft 48, film shutter 38 moves, as an example, from the position depicted in FIG. 3, then the position depicted in FIG. 4, then the position depicted in FIG. 5, then the position depicted in FIG. 6. FIG. 6 depicts film shutter 38 in a position in which the entire radiator surface 44 is blocked from airflow 34. In an alternative arrangement, film shutter 38 may be placed in a position in which the entire radiator surface and condenser 16 are blocked from flow-through airflow 34. That is, even with the film shutter 38 positioned between radiator 18 and condenser 16, effective flow-through air 44 is prevented from flowing through both, radiator surface 44 and the condenser surface. Because film shutter 38 acts as a shutter in front of radiator 18 and behind condenser 16, FIG. 6 depicts a 100% shutter closed or 0% shutter open position. Such a position may permit engine 12 to retain as much heat as possible regarding only the position of film shutter 38. FIG. 3 depicts film shutter 38 in a position that is essentially the opposite of the film position of FIG. 6 in that when film shutter 38 is not preventing any airflow from passing through radiator 18 or condenser 16, which is a 100% shutter open, or 0% closed position, as depicted in FIG. 3, engine 12 and air conditioner 15 may be cooled to maximum extent possible regarding only the position of film shutter 38.

Figure 7:
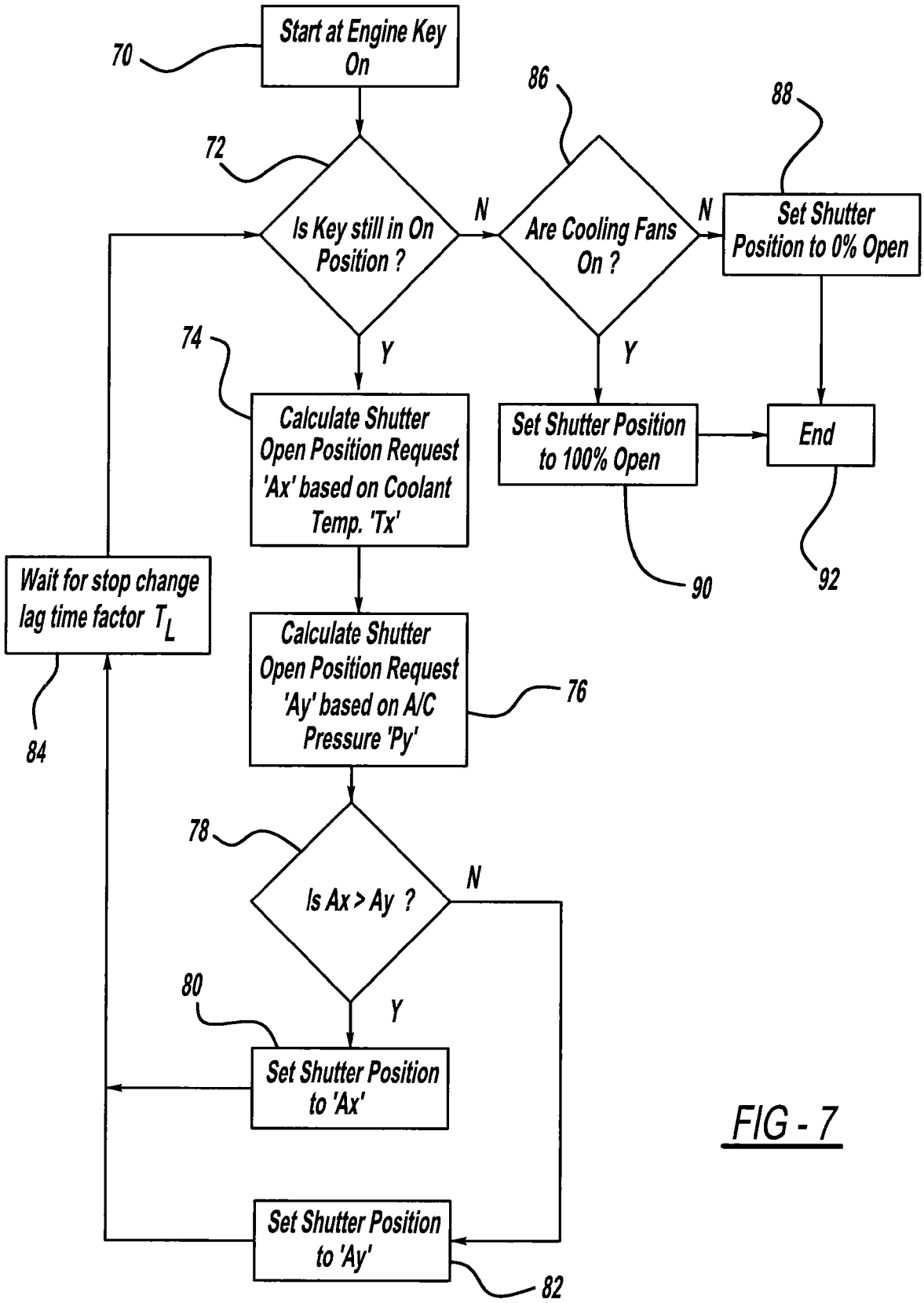
FIG. 7 is a flowchart depicting various steps in controlling the position of the film door.

Turning now to FIG. 7, a method of controlling the position of film shutter 38 will be described. The control logic for controlling film shutter 38 begins in FIG. 7 at step 70 when an ignition of vehicle 10 is turned to the "on" position, such as with a manual key. In the case of a vehicle with no physical key, the control logic of FIG. 7 may begin when the ignition is activated, such as when a start button is pressed to start an engine 12 of the vehicle 10. The control logic proceeds to step 72 where the logic inquires whether the key is still in an "on" position. If the reply is affirmative or yes, the control logic proceeds to step 74, where the logic calculates a shutter open position request "Ax" based upon liquid coolant temperature "Tx." Shutter open position Ax may be the percentage that film shutter 38 is open or the percentage of surface area of radiator surface 44 that is exposed to airflow 34. The control logic then proceeds to step 76, where the logic calculates a shutter open position request "Ay" based upon a/c refrigerant pressure Py. Shutter open position Ay may be the percentage that film shutter 38 is open or the percentage of surface area of radiator surface 44 that is exposed to airflow 34. The control logic then proceeds to step 78, where the desired shutter open position Ax based on coolant temperature Tx is compared to the desired open position Ay based on a/c pressure Py, and the greater of the two desired shutter open positions Ax at step 80 or Ay at step 82 is selected. Thus, the position to which shutter 38 is opened, that is, the extent to which film shutter 38 is pulled across radiator surface 44 to prevent a portion of airflow 34 from passing through radiator 18 and condenser 16, may be determined based upon the temperature of the liquid coolant that circulates within engine 12 and through radiator 18, and the pressure of the a/c refrigerant that circulates through the car air conditioner 15 and the condenser 16. Regardless of whether the shutter position is set to Ax at step 80, or Ay at step 82, the logic proceeds to step 84 where the logic waits for a stop change lag time factor $T_L$ before returning to step 72 to inquire whether the ignition is still in the "On" position. Step 84 is a user-definable time delay between iterations of calculating film shutter 38 position to prevent film shutter 38 and the logic controlling film shutter 38 from continually trying to change film shutter 38 position. Example time delays may be from zero seconds to five seconds; however, any time delay, which is programmable into the control logic, is possible.

Continuing with FIG. 7, if the ignition is not in the "On" position, after the query of step 72, then the logic proceeds to step 86 where the logic queries whether a cooling fan 32 is currently on and being driven by electric motor 30, for example. If cooling fan 32 is on, then the logic proceeds to step 90 and the shutter film shutter 38 is set to a 100% open position, such as that depicted in FIG. 3; however, if cooling fan 32 is not currently on, then the logic proceeds to step 88 where shutter film position is set to 0% open, which is 100% closed, as depicted in FIG. 6. Upon completion of the task specified in either step 88 or step 90, the logic proceeds to step 92 and ends. Upon restarting engine 12, the logic will again begin at step 70.

Figures 8, 9, 10:
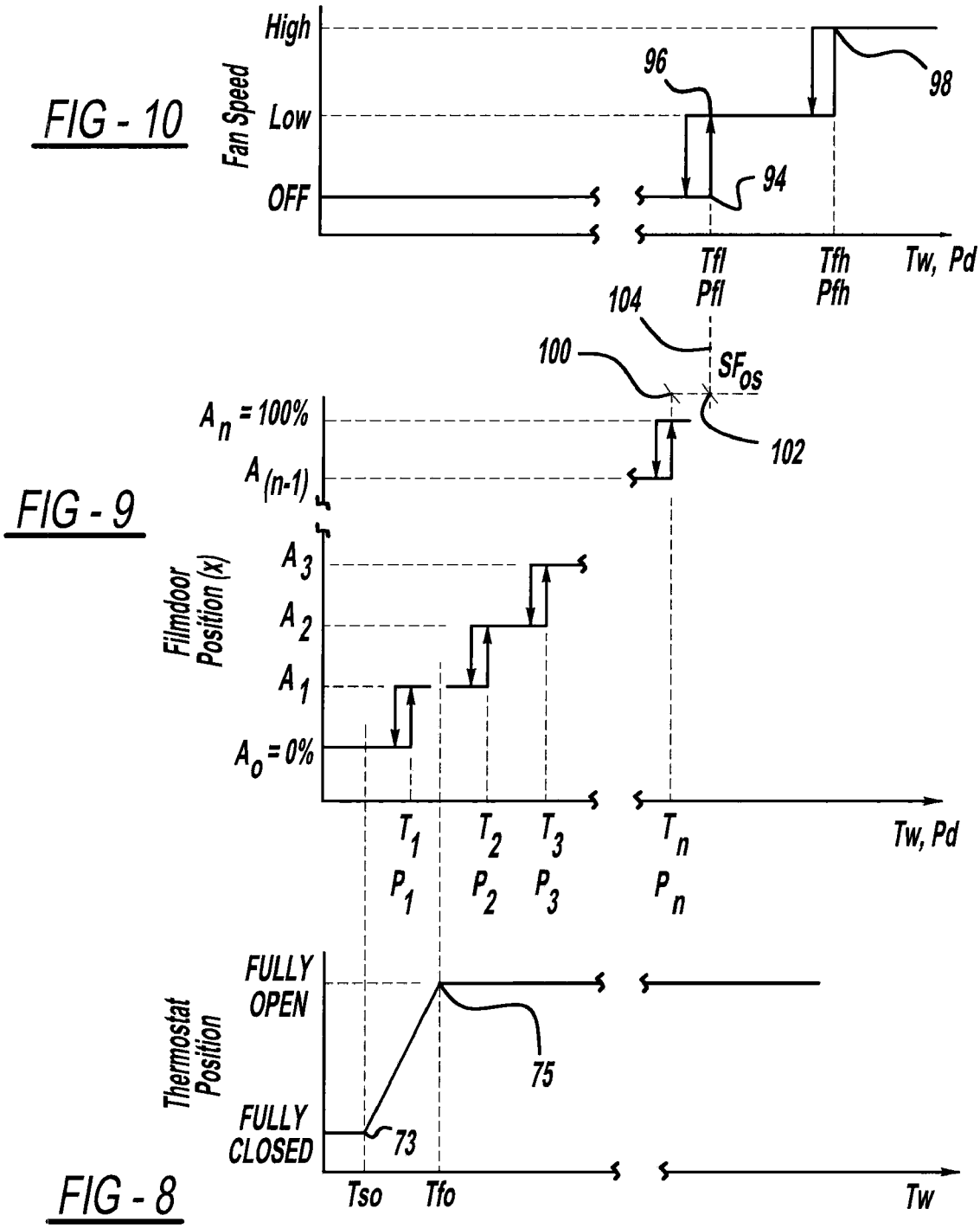
FIG. 8 is a graph depicting a thermostat position relative to engine coolant temperature.
FIG. 9 is a graph depicting film door position in accordance with coolant temperatures and air conditioning compressor pressures.
FIG. 10 is a graph depicting fan speed versus coolant temperatures and air conditioning compressor pressures.

FIGS. 8, 9 and 10 depict how film shutter 38 may be controlled relative to the other conventional cooling system control mechanisms that are retained in the system described herein. FIG. 8 depicts control of the conventional cooling system thermostat based on coolant temperature ("Tw"), FIG. 10 depicts control of the conventional vehicle cooling fan(s) based on coolant temperature and a/c discharge pressure ("Pd"), and FIG. 9 depicts control of the film door shutter 38 based on coolant temperature Tw and a/c discharge pressure Pd, and shows how the film door shutter control points may align relative to the control points on the conventional thermostat graph (FIG. 8) and cooling fan(s) graph (FIG. 10). More specifically, beginning with FIG. 8, the engine thermostat 71 will prevent coolant from flowing to the radiator 18 until the thermostat starts to open when temperature ("Tso") is reached at location 73. Thermostat 71 will open at an increasing level until the thermostat full open temperature ("Tfo") is reached at location 75.

Referring now to FIG. 9, the film door shutter 38 may be controlled to remain in the fully closed position until a coolant temperature of T1 between when the thermostat starts to open at location 73 (Tso) and the thermostat full open position Tfo is reached at location 75. When a coolant temperature of T1 is reached, which may be between the thermostat start to open position of Tso at location 73 and the thermostat full open position of Tfo at location 75, film shutter 38 may begin to move from a completely closed position, to some predetermined open position, such as that depicted in FIG. 5, as an example, thereby resulting in the uncovering of area of radiator surface 44. An advantage of maintaining film shutter 38 closed until warmed engine water (e.g. 170 degrees Fahrenheit) causes thermostat 71 to open, is so that radiator 18 is not thermally shocked. More specifically, with film shutter 38 kept closed, engine heat will gradually warm radiator 18 thus more slowly and evenly thermally conditioning radiator 18 and its brazed joints for contact with warmed engine coolant. Without shutter 38 in closed position, outside air may cool or maintain radiator 18 at ambient temperature (e.g. 30 degrees Fahrenheit) thus thermally shocking radiator with warmed water (e.g. 170 degrees Fahrenheit). Such thermal shocks may decrease the useful life of radiator 18 by decreasing the strength of the radiator material or crack brazed joints, thereby hastening coolant leaks from radiator 18. To control the rotation of motors 50, 52 and thus, the opening and closing of film shutter 38, and with reference to FIG. 3, a control module 83 may be utilized to communicate with motors 50, 52 using communication lines 79, 81 while devices such as coolant temperature sensor 67 and a/c pressure sensor 69 transmit signals to control module 83 by utilizing communication line 85, 87. FIG. 9 depicts one film door shutter open position between thermostat start to open and thermostat full open temperatures, but more positions could be used in this temperature range.

Continuing with FIGS. 8, 9 and 10, when the thermostat full open temperature Tfo is reached at location 75, additional film door shutter open positions may be available with increasing coolant temperature, depicted as A2, A3, etc. in FIG. 9. Film door open position may also be based on a/c pressure Pd, depending on which parameter (Tw or Pd) is requesting the greater film door shutter open position.

More specifically, FIG. 9 depicts a series of temperatures, $T_1, T_2, T_3 \ldots T_n$ and a series of pressures $P_1, P_2, P_3, \ldots P_n$. The temperatures and pressures may be predetermined and programmed into a memory of control module 83 such that when any of the predetermined temperatures $T_1, T_2, T_3 \ldots T_n$ or pressures $P_1, P_2, P_3, \ldots P_n$ are reached or met, film shutter 38 will move. In an exemplary method of operation, before temperature $T_1$ or $P_1$ is reached, film shutter 38 may be in the position depicted in FIG. 6, or 100% closed, 0% open, which corresponds to film door position $A_0$ in FIG. 9. When temperature $T_1$ or $P_1$ is met, which corresponds to position $A_1$ in FIG. 9, film shutter 38 may move to the position depicted in FIG. 5, which may be about 33% open or 67% closed. When temperature $T_2$ or pressure $P_2$ is met, which corresponds to position $A_2$ in FIG. 9, film shutter 38 may move again to a position that is more open, and exposes more of radiator surface 44, than that exposed in FIG. 5. Similarly, when temperature $T_3$ or pressure $P_3$ is met, which corresponds to position $A_3$ in FIG. 9, film shutter 38 may move again to a position that is more open, and exposes more of radiator surface 44, than is exposed at film door position $A_2$. With continued reference to FIG. 9, film door position $A_{(n-1)}$ may be set by motors 50, 52 via control module 83 when, for example, a temperature of $T_{(n-1)}$ or a discharge pressure of $P_{(n-1)}$ is reached. Also in the example depicted in FIG. 9, when temperature $T_n$ or pressure $P_n$ is reached, which both correspond to a door open position of $A_n$, film shutter 38 may be opened 100%, which is 0% closed, thereby exposing as much of radiator surface 44 as possible to flow through air 34, as depicted in FIG. 3. When film shutter 38 is open 100%, cooling air 34 will cool to its maximum possible extent. The full open film door shutter position ("An" in FIG. 9) may be reached before use of the vehicle cooling fans are required based on a coolant temperature of Tfl or an a/c discharge pressure of Pfl, as depicted in FIG. 10.

Continuing with FIGS. 9 and 10, $SF_{os}$ denotes the offset between when film shutter 38 is opened to its maximum of 100%, thereby exposing radiator surface 44 to as much cooling air as possible, and activation of electric motor 30 to turn cooling fan 32 to provide additional airflow to engine 12. Cooling fan 32 is invoked along with the opening of film shutter 38 when coolant temperature Tn and/or air conditioning compressor pressure Pn is higher than the corresponding engine coolant temperature and air conditioning compressor pressure that cause film shutter 38 to be opened to 100% to expose as much of radiator surface 44 as possible. Thus, with reference to FIGS. 9 and 10, an offset is depicted between location 100 and location 102 on FIG. 9. The offset represents the amount of either or both of a temperature of coolant and air conditioning compressor pressure that is higher than that necessary to cause film shutter 38 to open to its maximum amount, or 100%. As depicted with vertical line 104 that stretches from $SF_{os}$ 102 in FIG. 9 to Tfl, Pfl in FIG. 10, the electric motor 30 and cooling fan 32 are activated to provide cooling to engine 12 in addition to what is provided by the opening of the film shutter 38 to its maximum amount. Thus, the velocity and volume flow rate of airflow 34 may be increased to effect cooling over and around engine 12.

FIG. 10 depicts a conventional strategy or method for adjusting a speed of cooling fan 32 using electric motor 30. More specifically, FIG. 10 depicts a two-speed fan control methodology in which "Tfl" represents a predetermined liquid engine coolant low temperature at which electric motor 30 will turn on and drive fan 32 to remove heat from engine 12. Additionally, FIG. 10 depicts a pressure "Pfl" which represents a predetermined air conditioning discharge low pressure at which electric motor 30 will turn on and drive fan 32 to remove heat from engine 12. That is, if the fan is off and electric motor 30 is not rotating fan 32, then electric motor 30 will switch to a low fan speed setting 96 from a fan speed off setting 94 when either or both of Tfl or Pfl is reached. Similarly, "Tfh" represents a predetermined liquid engine coolant high temperature at which electric motor 30 will switch from low fan speed setting 96 to high fan speed setting 98 and drive fan 32 to remove heat from engine 12, and "Pfh" represents a predetermined air conditioning discharge high pressure at which electric motor 30 will switch from low fan speed setting 96 to high fan speed setting 98 and drive fan 32 to remove heat from engine 12. That is, if the fan is set to low fan speed setting 96, then electric motor 30 will switch to high fan speed setting 98 from low fan speed setting 96 when either or both of Tfh or Pfh is reached. A two-speed fan control is depicted in FIG. 10, but one or more fan speeds could be employed, including linear control.

Presented in slightly different terms, an apparatus for controlling a temperature of engine 12 in vehicle 10 may employ radiator 18 with inlet tank 26 and outlet tank 28. Radiator 18 and tanks 26, 28 may contain a liquid engine coolant to circulate through engine 12. Additionally, vertical first roller 40 positioned parallel to inlet tank 26 and vertical second roller 42 positioned parallel to outlet tank 28 may have a single sheet of flexible film, known also as a film shutter 38, wound upon them to move film shutter 38 across the front of radiator surface 44. To permit airflow through film shutter 38 so that surface 44 of radiator 18 may be reached by airflow 34, gaps may be defined between a plurality of film strips, also known as film leaders 62, 64, 66, 68. The gaps permit an adjustable airflow to flow through the film shutter 38. Adjusting the airflow through the film may correspond to an amount of the surface area of the radiator core that is exposed to the airflow. Adjusting the airflow is accomplished by rotating the rollers 40, 42. To rotate the first roller 40, a first motor 30 may be utilized while a second motor 30 may be utilized to rotate the second roller 42. Each motor 30 may reside on top of its respective roller 40, 42. A temperature sensor 67 may be used to measure temperatures of the liquid engine coolant, and a pressure sensor 69 may be used to measure the pressure of the a/c refrigerant, while a control module 83 may process the measured temperatures from the temperature sensor 67 and pressure sensor 69 then communicate with the first and second motors 50, 52 to turn the first and second rollers 40, 42 and move the film shutter 38 to a desired open position.

An air conditioning condenser 16 may be located in front of the radiator 18, that is, farther from engine 12 than the radiator 18, with film shutter 38 located between the radiator 18 and the condenser 16. An advantage of the present teachings is that use of film shutter 38 does not require an increase in the overall package size or dimensions of the engine components, and instead may be situated among the existing components. For instance, the film shutter 38 is located between the radiator 18 and air conditioning condenser 16. An air conditioning compressor 77 may employ a pressure sensor 69. Alternatively, the sensor may be located anywhere in the high-side of the refrigerant circuit (between the compressor and the expansion device). A high side pressure of the air conditioning compressor 77, which may be measured anywhere in the high side of the system, may be communicated to the first and second motor 50, 52 via the control module 83 to cause rotation in the first and second rollers 40, 42 to thereby move the film shutter 38 back and forth in front of radiator surface 44.

A method of controlling an open position of film shutter 38 in front of radiator of vehicle 10 may entail inquiring whether an ignition key is in an "on" position, concluding that the ignition key is in an "on" position, and calculating a first film shutter 38 open position based upon an engine coolant temperature from temperature sensor 67. Furthermore, the method may involve moving film shutter 38 to the calculated first film shutter open position using motors 50, 52. The shutter open position refers to the percentage of radiator surface 44 exposed to airflow 34. A second film shutter open position based upon air conditioning compressor 77 output pressure may be calculated. Shutter positions may be calculated by control module 83. With two calculated film positions, a comparison may be made between the first film shutter open position based upon an engine coolant temperature and the second film shutter open position based upon an air conditioning compressor output pressure. Film shutter 38 may be moved or positioned to either first film shutter open position or second film shutter open position, whichever position exposes the maximum radiator surface area 44 to permit airflow through radiator 18 to provide the greatest amount of cooling to the liquid engine coolant in radiator 18 and the a/c system refrigerant in condenser 16. The method may also entail activating electric engine cooling fan 32 when the engine coolant temperature reaches a predetermined temperature and activating the electric engine cooling fan when air conditioning compressor 77 reaches a predetermined, compressor high side, output pressure.

The foregoing description of the embodiments has been provided for purposes of illustration and description. It is not intended to be exhaustive or to limit the invention. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the invention, and all such modifications are intended to be included within the scope of the invention.

When an element or layer is referred to as being "on", "engaged to", "connected to" or "coupled to" another element or layer, it may be directly on, engaged, connected or coupled to the other element or layer, or intervening elements or layers may be present. In contrast, when an element is referred to as being "directly on," "directly engaged to", "directly connected to" or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Spatially relative terms, such as "inner," "outer," "beneath", "below", "lower", "above", "upper" and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

What is claimed is:

1. An apparatus for controlling airflow through a heat exchanger, comprising:

a radiator with an inlet tank and an outlet tank, the inlet tank and outlet tank located on opposite sides of the radiator to contain a liquid engine coolant;

a first roller positioned substantially parallel to the inlet tank;

a second roller positioned substantially parallel to the outlet tank;

at least a single sheet of film wound upon the first roller and the second roller; and at least one film leader that defines a gap in the film, the gap for permitting air to flow through the film.

2. The apparatus of claim 1, further comprising:

a first motor to drive the first roller; and a second motor to drive the second roller.

3. The apparatus of claim 2, further comprising:

a temperature sensor to measure temperatures of the liquid engine coolant;

a pressure sensor to measure a high side refrigerant pressure of an air conditioning compressor of an air conditioning system; and a control module that processes the measured temperatures from the temperature sensor and pressures from the pressure sensor and communicates with the first and second motors to turn the first and second rollers and move the film.

4. The apparatus of claim 3, further comprising:

an air conditioning condenser, wherein the film is located between the radiator and the air conditioning condenser.

5. The apparatus of claim 4, further comprising:

a plurality of film leaders, the film leaders defining a gap therebetween to permit the flow of air through the single sheet of film.

6. The apparatus of claim 5, wherein the film leaders are spaced apart from each other.

7. A method of controlling an open position of a dual roller film shutter for a radiator of a vehicle, the method comprising:

inquiring whether an ignition key is in an "on" position;

concluding that the ignition key is in an "on" position;

measuring a temperature of an engine coolant within the radiator; and calculating a first film shutter open position based upon the temperature of the engine coolant.

8. The method of claim 7, wherein the vehicle employs an air conditioning system, the method further comprising:

measuring a pressure of a refrigerant of the air conditioning system; and calculating a second film shutter open position based upon the pressure of the refrigerant of the air conditioning system.

9. The method of claim 8, wherein the pressure is a high side pressure of the air conditioning system.

10. The method of claim 9, further comprising:

comparing the first film shutter open position to the second film shutter open position; and moving the film shutter to one of the first film shutter open position or the second film shutter open position.

11. The method of claim 10, further comprising:

moving the dual roller film shutter to a film shutter open position that exposes a maximum radiator surface area to airflow through the radiator.

12. The method of claim 11, further comprising:

inquiring whether an electric engine cooling fan is activated; and adjusting a shutter film position to 100% open when the electric engine cooling fan is activated.

13. A method of controlling an open position of a dual roller film shutter to expose a surface area of a radiator of a vehicle, the method comprising:

inquiring whether an ignition key is in an "on" position;

concluding that the ignition key is in the "on" position;

measuring a temperature of an engine coolant of the vehicle;

calculating a first film shutter open position based upon the temperature of the engine coolant;

measuring an output pressure of a refrigerant of an air conditioning system of the vehicle;

calculating a second film shutter open position based upon the output pressure of the air conditioning system;

comparing the first film shutter open position to the second film shutter open position;

deciding which of the first film shutter open position and second film shutter open position exposes a larger surface area of the radiator; and moving the dual roller film shutter to a film shutter position that exposes the larger surface area of the radiator.

14. A method of controlling an open position of the apparatus of claim 1, the method comprising:

inquiring whether an ignition key is in an "on" position;

concluding that the ignition key is not in an "on" position;

inquiring whether a vehicle cooling fan is activated;

arriving at a result pertaining to whether the vehicle cooling fan is activated; and adjusting a film shutter position based on the result.

15. The method of claim 14, wherein arriving at a result pertaining to whether the vehicle cooling fan is activated further comprises arriving at a result that the electric engine cooling fan is activated, the method further comprising:

adjusting a shutter film position to 100% open.

16. The method of claim 14, wherein arriving at a result pertaining to whether the vehicle cooling fan is activated further comprises arriving at a result that the electric engine cooling fan is not activated, the method further comprising:

adjusting a shutter film position to 0% open.

17. The method of claim 7, further comprising:

providing a first roller onto which the dual roller film shutter is rolled.

18. The method according to claim 17 further comprising:

providing a second roller onto which the dual roller film shutter is rolled.

19. The method according to claim 13, wherein the step of moving the dual roller film shutter comprises rolling the dual roller film shutter onto a roller.

* * * * *